US011959042B2

(12) United States Patent
Kim

(10) Patent No.: US 11,959,042 B2
(45) Date of Patent: Apr. 16, 2024

(54) LUBRICANT COMPOSITION WITH IMPROVED LOW-TEMPERATURE FLUIDITY AND METHOD FOR PREPARING SAME

(71) Applicants: Hyundai Motor Company, Seoul (KR); Kia Corporation, Seoul (KR)

(72) Inventor: Jae Hyeon Kim, Gyeongsangnam-do (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/968,104

(22) Filed: Oct. 18, 2022

(65) Prior Publication Data

US 2023/0159849 A1 May 25, 2023

(30) Foreign Application Priority Data

Nov. 22, 2021 (KR) ..... 10-2021-0161277

(51) Int. Cl.

| | |
|---|---|
| ***C10M 169/04*** | (2006.01) |
| ***C10M 107/34*** | (2006.01) |
| ***C10M 129/16*** | (2006.01) |
| ***C10M 129/40*** | (2006.01) |
| ***C10M 129/50*** | (2006.01) |
| ***C10M 177/00*** | (2006.01) |
| *C10N 20/02* | (2006.01) |
| *C10N 30/02* | (2006.01) |
| *C10N 30/10* | (2006.01) |
| *C10N 70/00* | (2006.01) |

(52) U.S. Cl.

CPC ..... *C10M 169/04* (2013.01); *C10M 107/34* (2013.01); *C10M 129/16* (2013.01); *C10M 129/40* (2013.01); *C10M 129/50* (2013.01); *C10M 177/00* (2013.01); *C10M 2207/046* (2013.01); *C10M 2207/126* (2013.01); *C10M 2207/16* (2013.01); *C10M 2209/1033* (2013.01); *C10N 2020/02* (2013.01); *C10N 2030/02* (2013.01); *C10N 2030/10* (2013.01); *C10N 2070/00* (2013.01)

(58) Field of Classification Search

CPC ..... C10M 169/04; C10M 107/34; C10M 129/16; C10M 129/40; C10M 129/50; C10M 177/00; C10M 2207/046; C10M 2207/126; C10M 2207/16; C10M 2209/1033; C10N 2020/02; C10N 2030/02; C10N 2030/10; C10N 2070/00

See application file for complete search history.

(56) References Cited

FOREIGN PATENT DOCUMENTS

| | | | | | |
|---|---|---|---|---|---|
| CN | 109111977 | A | * | 1/2019 | |
| JP | 2003034797 | A | * | 2/2003 | |
| KR | 2020-0054740 | A | | 5/2020 | |
| WO | WO-2014089766 | A1 | * | 6/2014 | ..... C08L 71/02 |

* cited by examiner

*Primary Examiner* — Taiwo Oladapo
(74) *Attorney, Agent, or Firm* — Fox Rothschild LLP

(57) ABSTRACT

Disclosed are a lubricant composition and a method of preparing the same. The lubricant composition has improved low-temperature fluidity and includes polyalkylene glycol, a glycol ether compound, and an antioxidant.

15 Claims, No Drawings

LUBRICANT COMPOSITION WITH IMPROVED LOW-TEMPERATURE FLUIDITY AND METHOD FOR PREPARING SAME

CROSS-REFERENCE TO RELATED APPLICATION

This application claims under 35 U.S.C. § 119(a) the benefit of priority to Korean Patent Application No. 10-2021-0161277 filed on Nov. 22, 2021, the entire contents of which are incorporated herein by reference.

TECHNICAL FIELD

The present invention relates to a lubricant composition, and a method for preparing the same. The lubricant composition may have improved low-temperature fluidity by including polyalkylene glycol, a glycol ether compound, and an antioxidant.

BACKGROUND

A lubricant may be used in braking systems and braking parts and make the operations of the braking systems and braking parts smooth.

Therefore, when the lubricant is exposed to the outside, it is necessary to consider the fluidity according to temperature as well as the reliable lubrication and NVH(Noise, Vibration, Harshness) performance.

Meanwhile, a conventional lubricant changes in physical properties including viscosity characteristics depending on temperature, which causes the degradation in performance as a lubricant.

A glycol-based lubricant generally used has poor fluidity due to its increased viscosity when used at low temperatures, which causes a problem of lowering the efficiency of the braking system. On the other hand, when the viscosity of the lubricant is simply decreased in order to solve this problem, the thickness of an oil film is decreased, which may cause a problem in that the durability of the braking system is deteriorated.

Accordingly, under the background described above, the development of a lubricant composition having excellent fluidity at low temperatures is continuously in progress.

SUMMARY OF THE INVENTION

In preferred aspects, provided is a lubricant composition having improved low-temperature fluidity and a method for preparing the same.

The objects of the present invention are not limited to the object mentioned above. The objects of the present invention will become more apparent from the following description, and will be realized by means described in the claims and combinations thereof.

In an aspect, provided is a lubricant composition including: an amount of about 85 to 95% by weight of polyalkylene glycol (PAG); an amount of about 4 to 10% by weight of a glycol ether compound; and an amount of about 1 to 5% by weight of an antioxidant, based on the total weight of the lubricant composition.

The polyalkylene glycol may have a viscosity of about 20 to 75 cSt at a temperature of about 40° C.

The glycol ether compound may include monoethylene glycol dimethyl ether (DME), monoethylene glycol monomethyl ether (EGME), or a combination thereof.

The glycol ether compound may include monoethylene glycol dimethyl ether and monoethylene glycol monomethyl ether at a weight ratio of about 1:2 to 1:3.

The antioxidant may include lithium-stearate, zinc-naphthenate, or a combination thereof.

The lubricant composition may have a viscosity of about 24 to 28 Pa·s measured at a temperature of about −30° C. according to DIN51810.

In an aspect, provided is a method for preparing a lubricant composition including steps of: preparing an admixture including polyalkylene glycol (PAG) and a glycol ether compound; heat-treating the admixture in the presence of a catalyst; and injecting an antioxidant into a heat-treated resulting product. The lubricant composition may include an amount of about 85 to 95% by weight of the polyalkylene glycol, an amount of about 4 to 10% by weight of the glycol ether compound, and an amount of about 1 to 5% by weight of the antioxidant, based on the total weight of the lubricant composition.

The polyalkylene glycol may have a viscosity of about 20 to 75 cSt at a temperature of about 40° C.

The polyalkylene glycol may be mixed with an aqueous solvent.

The glycol ether compound may include monoethylene glycol dimethyl ether (DME), monoethylene glycol monomethyl ether (EGME), or a combination thereof.

The glycol ether compound may suitably include monoethylene glycol dimethyl ether and monoethylene glycol monomethyl ether at a weight ratio of about 1:2 to 1:3.

In the method for preparing a lubricant composition, the admixture may be heat-treated in a nitrogen atmosphere.

In the method for preparing a lubricant composition, the admixture may be heat-treated to a temperature of about 80 to 120° C.

In the method for preparing a lubricant composition, the antioxidant may be injected when the heat-treated resulting product is at a temperature of about 60 to 80° C.

The antioxidant may include lithium-stearate, zinc-naphthenate, or a combination thereof.

The method for preparing a lubricant composition may further comprise a step of performing a cooling process after the step of injecting the antioxidant.

The lubricant composition prepared according to the method described herein may have a viscosity of about 24 to 28 Pa·s measured at a temperature of about −30° C. according to DIN51810.

The lubricant composition can improve low-temperature fluidity by blending polyalkylene glycol, a glycol ether compound, and an antioxidant in specific amounts.

The lubricant composition according to various exemplary embodiments of the present invention can improve the durability of a braking system by increasing the thickness of an oil film while improving the efficiency of the braking system by reducing the viscosity when used at low temperatures as a lubricant in the braking system.

The effects of the present invention are not limited to the above-mentioned effects. It should be understood that the effects of the present invention include all effects that can be inferred from the following description.

Other aspects of the invention are disclosed infra.

DETAILED DESCRIPTION

The above objects, other objects, features and advantages of the present invention will be easily understood through the following preferred embodiments. However, the present invention is not limited to the embodiments described herein and may be embodied in other forms. Rather, the embodiments introduced herein are provided so that the disclosed content may become thorough and complete, and the spirit of the present invention may be sufficiently conveyed to those skilled in the art.

In the present specification, terms such as "comprise" and "have" are intended to designate that a feature, number, step, operation, component, part, or a combination thereof described in the specification exists, but it should be understood that the terms do not preclude the possibility of the existence or addition of one or more other features, numbers, steps, operations, components, parts, or combinations thereof.

Unless otherwise specified, since all numbers, values, and/or expressions expressing quantities of components, reaction conditions, polymer compositions and formulations used in the present specification are approximate values reflecting various uncertainties of the measurement that arise in obtaining these values among others in which these numbers are essentially different, they should be understood as being modified by the term "about" in all cases. Further, when a numerical range is disclosed in this description, such a range is continuous, and includes all values from a minimum value of such a range to a maximum value including the maximum value, unless otherwise indicated.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Furthermore, when such a range refers to an integer, all integers including from a minimum value to a maximum value including the maximum value are included, unless otherwise indicated.

In the present specification, when a range is described for a variable, the variable will be understood to include all values within the stated range including the stated endpoints of the range. For example, it will be understood that a range of "5 to 10" not only includes any subranges such as 6 to 10, 7 to 10, 6 to 9, and 7 to 9 as well as the values of 5, 6, 7, 8, 9, and 10, but also includes any value between integers that are appropriate for the category of the stated range such as 5.5, 6.5, 7.5, 5.5 to 8.5, and 6.5 to 9. Further for example, it will be understood that a range of "10% to 30%" not only includes any subranges such as 10% to 15%, 12% to 18%, and 20% to 30% as well as all integers including values such as 10%, 11%, 12%, and 13% and values up to 30%, but also includes any value between integers that are appropriate within the category of the stated range such as 10.5%, 15.5%, and 25.5%.

In an aspect, provided is a lubricant composition that includes: an amount of about 85 to 95% by weight of polyalkylene glycol; an amount of about 4 to 10% by weight of a glycol ether compound; and an amount of about 1 to 5% by weight of an antioxidant based on the total weight of the lubricant composition.

If the standard of the content is changed, the changed standard will always be specified so that those of ordinary skill in the art will be able to clearly see on which composition the content is described based.

Each component constituting the lubricant composition n will be described in more detail as follows.

(1) Polyalkylene Glycol (PAG)

Polyalkylene glycol as used herein is a basic raw material of lubricant, and is a synthetic base oil with better viscosity-temperature characteristics, low-temperature fluidity, lubricity, and flame retardancy than mineral oil.

In particular, the polyalkylene glycol is based on alcohols, and is synthesized by performing addition polymerization of alkylene oxides (ethylene oxide, propylene oxide, and butylene oxide). Polyalkylene glycol whose both ends are substituted by the previously listed functional groups has the functional groups presenting at the ends thereof and the amino group of oleyl propylene diamine bonded thereto so that the base oil cannot directly react with moisture ($H_2O$) in the air.

Preferably, the polyalkylene glycol may be included in an amount of about 85 to 95% by weight based on the total content of the lubricant composition.

The polyalkylene glycol may have a viscosity of about 20 to 75 cSt measured at a temperature of about 40° C. At this time, when the viscosity of polyalkylene glycol is less than about 20 cSt, it may be difficult for the lubricant composition to maintain the viscosity, and when the viscosity is greater than about 75 cSt, the effect of improving the low-temperature viscosity at low temperatures may be insufficient. In particular, when the viscosity of polyalkylene glycol is greater than about 90 cSt, the solubility is lowered so that a problem may arise in that a layer separation phenomenon occurs.

(2) Glycol Ether Compound

The glycol ether compound as used herein may improve a low-temperature viscosity and an oil film thickness in the lubricant composition, and is soluble in the polyalkylene glycol.

The glycol ether compound may be included in an amount of about 4 to 10% by weight based on the total content of the lubricant composition. At this time, when the glycol ether compound is included in an amount less than about 4% by weight, the effect of improving the low temperature properties and oil film thickness may be insufficient, and when it is included in an amount greater than about 10% by weight, a problem may arise in that the layer separation phenomenon at low temperatures occurs.

The glycol ether compound may be used alone or in a mixed form. Preferably, the glycol ether compound may include monoethylene glycol dimethyl ether (DME), monoethylene glycol monomethyl ether (EGME), or a combination thereof.

In particular, when the glycol ether compound includes an admixture of monoethylene glycol dimethyl ether and monoethylene glycol monomethyl ether, the glycol ether compound may include monoethylene glycol dimethyl ether and monoethylene glycol monomethyl ether at a weight ratio of about 1:2 to 1:3. At this time, when the weight ratio is out of the above-mentioned weight ratio range, the effect of improving the low-temperature viscosity of the lubricant composition may be insufficient.

(3) Antioxidant

The antioxidant as used herein may be an additive, and may improve the performance of the lubricant composition.

The antioxidant may be included in an amount of about 1 to 5% by weight based on the total content of the lubricant composition.

Particularly, as the antioxidant, lithium-stearate, zinc-naphthenate, and a combination thereof may be used.

In another aspect, provided is a method for preparing the lubricant composition described herein. The method may include steps of: preparing an admixture containing polyalkylene glycol and a glycol ether compound; heat-treating the admixture in the presence of a catalyst; and injecting an antioxidant into a heat-treated resulting product.

Subsequently, the method for preparing the lubricant composition will be described in detail as follows.

First, the admixture may be prepared by mixing an amount of about 85 to 95% by weight of polyalkylene glycol and an amount of about 4 to 10% by weight of the glycol ether compound, based on the total weight of the admixture. At this time, the admixture may be heat-treated at a temperature of about 80 to 90° C.

In the admixture, the polyalkylene glycol may be mixed with an aqueous solvent in an appropriate amount. The polyalkylene glycol may have a viscosity of about 20 to 75 cSt at a temperature of about 40° C.

In the admixture, monoethylene glycol dimethyl ether, monoethylene glycol monomethyl ether, or a combination thereof may be used as the glycol ether compound.

When monoethylene glycol dimethyl ether and monoethylene glycol monomethyl ether are mixed for use, monoethylene glycol dimethyl ether and monoethylene glycol monomethyl ether may be mixed at a weight ratio of about 1:2 to 1:3.

Next, the admixture may be heat-treated in the presence of a catalyst. The heat treatment of the admixture may be performed in a nitrogen gas atmosphere at a temperature of about 90 to 120° C. At this time, the nitrogen gas may serve as a catalyst.

Subsequently, an amount of about 1 to 5% by weight of the antioxidant may be injected into a heat-treated resulting product and mixed. The antioxidant may be injected at a temperature of about 60 to 80° C.

The antioxidant selected from the group consisting of lithium-stearate, zinc-naphthenate, and a combination thereof may suitably be used.

The method for preparing the lubricant composition may further include a step of performing a cooling process after the step of injecting the antioxidant. The cooling process may be performed at a room temperature, e.g., at a temperature of about 10 to 30° C.

The lubricant composition prepared by the methods described herein may have a viscosity of about 24 to 28 Pa·s measured at a temperature of about −30° C. according to DIN51810.

EXAMPLE

Hereinafter, the present invention will be described in more detail through specific Examples. The following Examples are merely illustrative to help the understanding of the present invention, and the scope of the present invention is not limited thereto.

Examples 1 to 4 and Comparative Examples 1 to 11

Lubricant compositions were prepared in the following manner by mixing the composition components at composition ratios as shown in Tables 1 and 2 below.

First, polyalkylene glycol mixed with an aqueous solvent was mixed with a glycol ether compound at a temperature of 85° C. Subsequently, the resulting admixture was heat-treated for a certain time in a nitrogen atmosphere at a temperature of 102° C. Finally, after mixing an antioxidant with the heat-treated resulting product at a temperature of 80° C., the admixture cooled at room temperature to finally prepare each lubricant composition. Here, it is appreciated that compounds manufactured from Lotte Chemical products were used as the respective components used herein.

Respective Components Constituting the Lubricant Compositions (1) Polyalkylene Glycol PAG (40 cSt): Polyalkylene glycol having a viscosity of 40 cSt at a temperature of 40° C.

PAG (73 cSt): Polyalkylene glycol having a viscosity of 73 cSt at a temperature of 40° C.

PAG (80 cSt): Polyalkylene glycol having a viscosity of 80 cSt at a temperature of 40° C.

PAG (90 cSt): Polyalkylene glycol having a viscosity of 90 cSt at a temperature of 40° C.

(2) Glycol Ether Compound

EMGE: Monoethylene Glycol Monomethyl Ether

DME: Monoethylene glycol dimethyl ether (3) Antioxidant

Li-stearate

Zn-naphthenate

TABLE 1

| Components (% by weight) | | Example 1 | Example 2 | Example 3 | Example 4 |
|---|---|---|---|---|---|
| Polyalkylene glycol | PAG (40 cSt) | 91 | 91 | 91 | 91 |
| Glycol ether | EMGE | 6 | 0 | 4 | 4.5 |
| compound | DME | 0 | 6 | 2 | 1.5 |
| Antioxidant | Li-stearate | 2.8 | 2.8 | 2.8 | 2.8 |
| | Zn-naphthenate | 0.2 | 0.2 | 0.2 | 0.2 |
| Total | | 100 | 100 | 100 | 100 |

TABLE 2

| Components (% by weight) | | Comparative Example 1 | Comparative Example 2 | Comparative Example 3 | Comparative Example 4 | Comparative Example 5 | Comparative Example 6 |
|---|---|---|---|---|---|---|---|
| Polyalkylene glycol | PAG (40 cSt) | 97 | 85 | 85 | 94 | 94 | 91 |
| | PAG (73 cSt) | — | — | — | — | — | — |
| | PAG (80 cSt) | — | — | — | — | — | — |
| | PAG (90 cSt) | | | | | | |

TABLE 2-continued

| | | | | | | | |
|---|---|---|---|---|---|---|---|
| Glycol ether compound | EMGE | 0 | 12 | 0 | 3 | 0 | 2 |
| | DME | 0 | 0 | 12 | 0 | 3 | 4 |
| Antioxidant | Li-stearate | 2.8 | 2.8 | 2.8 | 2.8 | 2.8 | 2.8 |
| | Zn-naphthenate | 0.2 | 0.2 | 0.2 | 0.2 | 0.2 | 0.2 |
| Total | | 100 | 100 | 100 | 100 | 100 | 100 |

| Components (% by weight) | | | Comparative Example 7 | Comparative Example 8 | Comparative Example 9 | Comparative Example 10 | Comparative Example 11 |
|---|---|---|---|---|---|---|---|
| | Polyalkylene glycol | PAG (40 cSt) | 91 | 91 | — | — | — |
| | | PAG (73 cSt) | — | — | — | — | 97 |
| | | PAG (80 cSt) | — | — | — | 91 | — |
| | | PAG (90 cSt) | | | 91 | | — |
| | Glycol ether compound | EMGE | 1 | 5 | 0 | 6 | 0 |
| | | DME | 5 | 1 | 6 | 0 | 0 |
| | Antioxidant | Li-stearate | 2.8 | 2.8 | 2.8 | 2.8 | 2.8 |
| | | Zn-naphthenate | 0.2 | 0.2 | 0.2 | 0.2 | 0.2 |
| | Total | | 100 | 100 | 100 | 100 | 100 |

Each of the prepared lubricant compositions was measured for physical properties by the method shown in Table 3 below, and the results are shown in Tables 4 and 5 below.

TABLE 3

| Evaluation items | Evaluation standard | Evaluation conditions |
|---|---|---|
| Low-temperature viscosity | DIN 51810 | GAP: 0.1 mm<br>Temperature: −30° C.<br>Shear rate: 100/s, one-way rotation<br>Evaluation time: 5 minutes<br>Stabilization for 30 seconds and measurement of the average values of 90 point data for 4 minutes and 30 seconds |
| Oil film thickness | Self-test | Ball load: 20N<br>Temperature: 25° C.<br>SRR : 0%<br>Disc Rolling speed (Disc): 0.1 to 1,000 mm/s<br>Confirmation of oil film thickness data at 1,000 mm/s speed<br>Evaluation in which the wavelength of reflected light as the thickness of the oil film, which is formed on the ball and the disk when the disk is rotated after the ball (Cr) and the lubricant material (300 ml) are applied to the bottom of the sapphire disk through which light is transmitted, is read with a spectrometer, and the read wavelength of reflected light is converted into the thickness of the oil film |

TABLE 4

| Evaluation items | Example 1 | Example 2 | Example 3 | Example 4 |
|---|---|---|---|---|
| Low-temperature viscosity (−30° C., Pa · s) | 28 | 25 | 26 | 24 |
| Oil film thickness (25° C., nm) | 645 | 624 | 637 | 640 |

TABLE 5

| Evaluation items | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 | Comparative Example 11 |
|---|---|---|---|---|---|---|---|---|---|---|---|
| Low-temperature viscosity (−30° C., Pa · s) | 42 | (Layer separation) | (Layer separation) | 41 | 40 | 36 | 48 | 47 | (Layer separation) | 51 | 81 |
| Oil film thickness (25° C., nm) | 572 | 567 | 538 | 569 | 556 | 542 | 569 | 572 | (Layer separation) | 693 | 640 |

As shown in Table 5, Comparative Example 1, which is a conventional glycol-based lubricant to which a glycol ether compound is not added, exhibited the poor effect of improving low-temperature viscosity and oil film thickness.

Further, when the glycol ether compound was used alone, a layer separation phenomenon at low temperatures occurred in Comparative Examples 2 and 3 in which the glycol ether compound was added in excess. In addition, the effect of improving the low-temperature viscosity and oil film thickness was relatively poor in Comparative Examples 4 and 5 in which the glycol ether compound was added in a small amount.

Further, when the glycol ether compounds were mixed for use, the effect of improving the low-temperature viscosity and oil film thickness was also relatively poor in Comparative Examples 6 to 8 in which the weight ratio of monoethylene glycol dimethyl ether to monoethylene glycol monomethyl ether was out of 1:2 to 1:3.

Therefore, when the glycol ether compounds were mixed for use, unsatisfactory results occurred if the mixing ratio deviated from a specific mixing ratio although the glycol ether compounds each were used within a range of 4 to 10% by weight.

Further, the layer separation phenomenon at room temperature and low temperatures occurred in Comparative Example 9 in which polyalkylene glycol had a viscosity of 90 cSt.

In addition, in Comparative Example 10 in which polyalkylene glycol had a viscosity of 80 cSt, the oil film thickness was increased, but the low-temperature viscosity was relatively poor.

Therefore, the viscosities of polyalkylene glycol affect the low-temperature viscosities of the lubricant compositions.

Meanwhile, the low-temperature viscosity was relatively poor in Comparative Example 11 which the oil film thickness was increased by adjusting the viscosity of polyalkylene glycol to 73 cSt without adding the glycol ether compound.

On the other hand, as shown in Table 4, the respective components were used in appropriate amounts in Examples 1 to 4 so that the lubricant compositions had viscosity values of 24 to 28 Pa·s measured at a temperature of −30° C. according to DIN51810, and the oil film thickness values were measured as 620 nm or more at room temperature.

In particular, in the case that the glycol ether compounds were mixed for use (Examples 3 and 4), when the weight ratio of monoethylene glycol dimethyl ether to monoethylene glycol monomethyl ether was 1:2 to 1:3, the viscosity values measured at a temperature of −30° C. were 24 to 26 Pa·s, and the oil film thickness values were measured as 637 to 640 nm at room temperature, indicating optimal performance.

Therefore, the lubricant composition according to various exemplary embodiments of the present invention can improve low-temperature fluidity by blending polyalkylene glycol, the glycol ether compound, and the antioxidant in specific amounts.

Further, the lubricant composition according to various exemplary embodiments of the present invention can improve the efficiency of the braking system by about 5 to 8% by reducing the viscosity by 40% at low temperatures when used as a braking system lubricant, and can improve the durability of the braking system by increasing the oil film thickness by 10%.

Hereinabove, exemplary embodiments of the present invention have been described, but those with ordinary skill in the art to which the present invention pertains will understand that the present invention may be implemented in other specific forms without changing the technical spirit or essential features thereof. Therefore, it should be understood that the embodiments described above are illustrative in all respects, not restrictive.

What is claimed is:

1. A lubricant composition comprising:

an amount of about 85 to 95% by weight of polyalkylene glycol (PAG);

an amount of about 4 to 10% by weight of a glycol ether compound; and an amount of about 1 to 5% by weight of an antioxidant, based on the total weight of the lubricant composition, wherein the glycol ether compound comprises monoethylene glycol dimethyl ether and monoethylene glycol monomethyl ether at a weight ratio of about 1:2 to 1:3.

2. The lubricant composition of claim 1, wherein the polyalkylene glycol has a viscosity of about 20 to 75 cSt at a temperature of about 40° C.

3. The lubricant composition of claim 1, wherein the antioxidant comprises lithium-stearate, zinc-naphthenate, or a combination thereof.

4. The lubricant composition of claim 1, wherein the lubricant composition has a viscosity of about 24 to 28 Pa·s measured at a temperature of about −30° C. according to DIN51810.

5. A method for preparing a lubricant composition, the method comprising steps of:

preparing an admixture comprising polyalkylene glycol (PAG) and a glycol ether compound;

heat-treating the admixture in the presence of a catalyst; and injecting an antioxidant into a heat-treated resulting product, wherein the lubricant composition comprises: an amount of about 85 to 95% by weight of polyalkylene glycol; an amount of about 4 to 10% by weight of the glycol ether compound; and an amount of about 1 to 5% by weight of the antioxidant, based on the total weight of the lubricant composition.

6. The method of claim 5, wherein the polyalkylene glycol has a viscosity of about 20 to 75 cSt at a temperature of about 40° C.

7. The method of claim 5, wherein the polyalkylene glycol is mixed with an aqueous solvent.

8. The method of claim 5, wherein the glycol ether compound comprises glycol dimethyl ether (DME), monoethylene glycol monomethyl ether (EGME), or a combination thereof.

9. The method of claim 5, wherein the glycol ether compound comprises monoethylene glycol dimethyl ether and monoethylene glycol monomethyl ether at a weight ratio of about 1:2 to 1:3.

10. The method of claim 5, wherein the admixture is heat-treated in a nitrogen atmosphere.

11. The method of claim 5, wherein the admixture is heat-treated to a temperature of about 80 to 120° C.

12. The method of claim 5, wherein the antioxidant is injected when the heat-treated resulting product is at a temperature of about 60 to 80° C.

13. The method of claim 5, wherein the antioxidant comprises lithium-stearate, zinc-naphthenate, or a combination thereof.

14. The method of claim 5, further comprising a step of performing a cooling process after the step of injecting the antioxidant.

15. The method of claim 5, wherein the lubricant composition has a viscosity of about 24 to 28 Pa·s measured at a temperature of about −30° C. according to DIN51810.

* * * * *